United States Patent [19]

Stanley

[11] 4,046,602

[45] Sept. 6, 1977

[54] PROCESS FOR PRODUCING NONORIENTED SILICON SHEET STEEL HAVING EXCELLENT MAGNETIC PROPERTIES IN THE ROLLING DIRECTION

[75] Inventor: Edward B. Stanley, Washington Twp., Westmoreland County, Pa.

[73] Assignee: United States Steel Corporation, Pittsburgh, Pa.

[21] Appl. No.: 677,200

[22] Filed: Apr. 15, 1976

[51] Int. Cl.[2] ..... H01F 1/04

[52] U.S. Cl. ..... 148/111; 148/31.55; 148/112; 75/123 L

[58] Field of Search ..... 148/111, 112, 31.55; 75/123 L

[56] References Cited

U.S. PATENT DOCUMENTS

| | | | |
|---|---|---|---|
| 3,203,839 | 8/1965 | Takahashi | 148/111 |
| 3,764,407 | 10/1973 | Hirano et al. | 148/111 |
| 3,770,517 | 11/1973 | Gray et al. | 148/111 |
| 3,834,952 | 9/1974 | Matsushita et al. | 148/111 |

*Primary Examiner*—Walter A. Satterfield
*Attorney, Agent, or Firm*—Forest C. Sexton

[57] ABSTRACT

A process for producing a fully processed nonoriented silicon sheet steel having excellent magnetic properties in the rolling direction wherein a steel containing 2.0 to 3.5% silicon and 0.30 to 0.45% aluminum is hot rolled to hot band gage, pickled, and cold rolled with a two-step cold roll with an intermediate anneal such that the second cold roll effects a thickness reduction to 50 to 60%. The cold rolled steel is then decarburized annealed and final annealed according to conventional practices.

1 Claim, 4 Drawing Figures

PROCESS FOR PRODUCING NONORIENTED SILICON SHEET STEEL HAVING EXCELLENT MAGNETIC PROPERTIES IN THE ROLLING DIRECTION

BACKGROUND OF THE INVENTION

Because of their superior magnetic properties, silicon sheet steels are widely used in the production of magnetic core components in electrical equipment such as motors, generators, transformers and the like. These favorable magnetic properties, namely high magnetic permeability, high electrical resistance and low hysteresis losses, minimize wasteful conversion of electrical energy into heat, and will therefore permit the manufacture of electrical equipment having greater power and efficiency.

Silicon sheet steels are normally divided into two classifications; grain oriented steels and nonoriented steels. The grain oriented silicon sheet steels are produced under very carefully controlled composition and process parameters so that generally over 90 percent of the secondary recrystallized grains exhibit a (110)[001] texture as described in U.S. Pat. No. 2,867,558, May. Because of this preferred orientation, the magnetic properties of such sheet steels are far superior in the direction parallel to the rolling direction, as compared to all other directions. This anisotropic characteristic makes sheet steels ideally suited as core material for stationary electrical equipment such as distribution transformers, because the core can be manufactured such that full advantage can be taken of the superior directional magnetic properties.

In the case of rotating electrical equipment, such as motors and generators, the magnetic properties must be reasonably uniform in all directions, and hence grain oriented sheet steels are not used therein. For these applications, the nonoriented sheet steels are produced, wherein very carefully controlled processing parameters are employed to optimize a random orientation of the steel grains, and thus optimize isotropic magnetic properties. Also, the nonoriented silicon steels exhibit a primary-recrystallized microstructure, a smaller grain size, and a rather weak texture as compared with grain oriented silicon steel. Because of the random orientation, the magnetic properties of a nonoriented sheet steel are not as good in the rolling direction as they are in oriented steels particularly at high flux densities.

In electrical equipment, such as ballast transformers or constant-voltage transformers employing an "I," "E" or "U" type laminations in the cores, it is essential to have good magnetic properties in both the rolling direction and the direction perpendicular thereto. Therefore, nonoriented silicon sheet steels are used in these transformers. Nevertheless, a number of manufacturers of such transformers prefer to avoid completely isotropic magnetic properties. That is, they desire an electrical sheet having somewhat enhanced magnetic properties in the rolling direction or main flux direction. In view of the fact that cold rolling a steel does tend to promote some degree of grain orientation in the rolling direction, a completely random orientation is perhaps not achievable in a cold rolled product as indicated in U.S. Pat. No. 3,203,839, Takahashi. Accordingly, even those silicon sheet steels classified as nonoriented are characterized by some degree of orientation, and hence slightly superior magnetic properties in the rolling direction. In the past therefore, it has not been difficult to satisfy those manufacturers who required nonoriented silicon sheet steel having somewhat superior magnetic properties in the rolling direction. Now, however, several such manufacturers are specifying minimum permeability values in the rolling direction, in addition to the usual core-loss requirements, which is difficult to achieve especially in the thinner gages, such as 29-gage. Of course, the grain oriented grades can readily meet the permeability requirements in the rolling direction, but these grades are much too costly to produce for use in these applications.

SUMMARY OF THE INVENTION

This invention is predicated upon my development of a process for producing thin-gage fully processed nonoriented silicon sheet steels having exceptionally good magnetic properties in the rolling direction, particularly the high flux density permeability. Although the process is of particular value in producing 29-gage AISI M-19 grade electrical steel or even better grades, it is also applicable to other AISI grades such as M-22, M-27 and M-36 whose magnetic requirements are less stringent than those of M-19 grade. Also, the process should not be restricted to 29-gage, but is applicable to thicker or thinner sheet products.

Accordingly, a primary object of this invention is to provide a process for producing fully processed nonoriented silicon sheet steel having exceptionally good magnetic properties in the rolling direction.

Another object of this invention is to provide a process for producing fully processed 29-gage M-19 grade electrical sheet steel having improved magnetic properties in the rolling direction, especially the high flux density permeability.

DESCRIPTION OF THE PREFERRED EMBODIMENT

Figure 1:
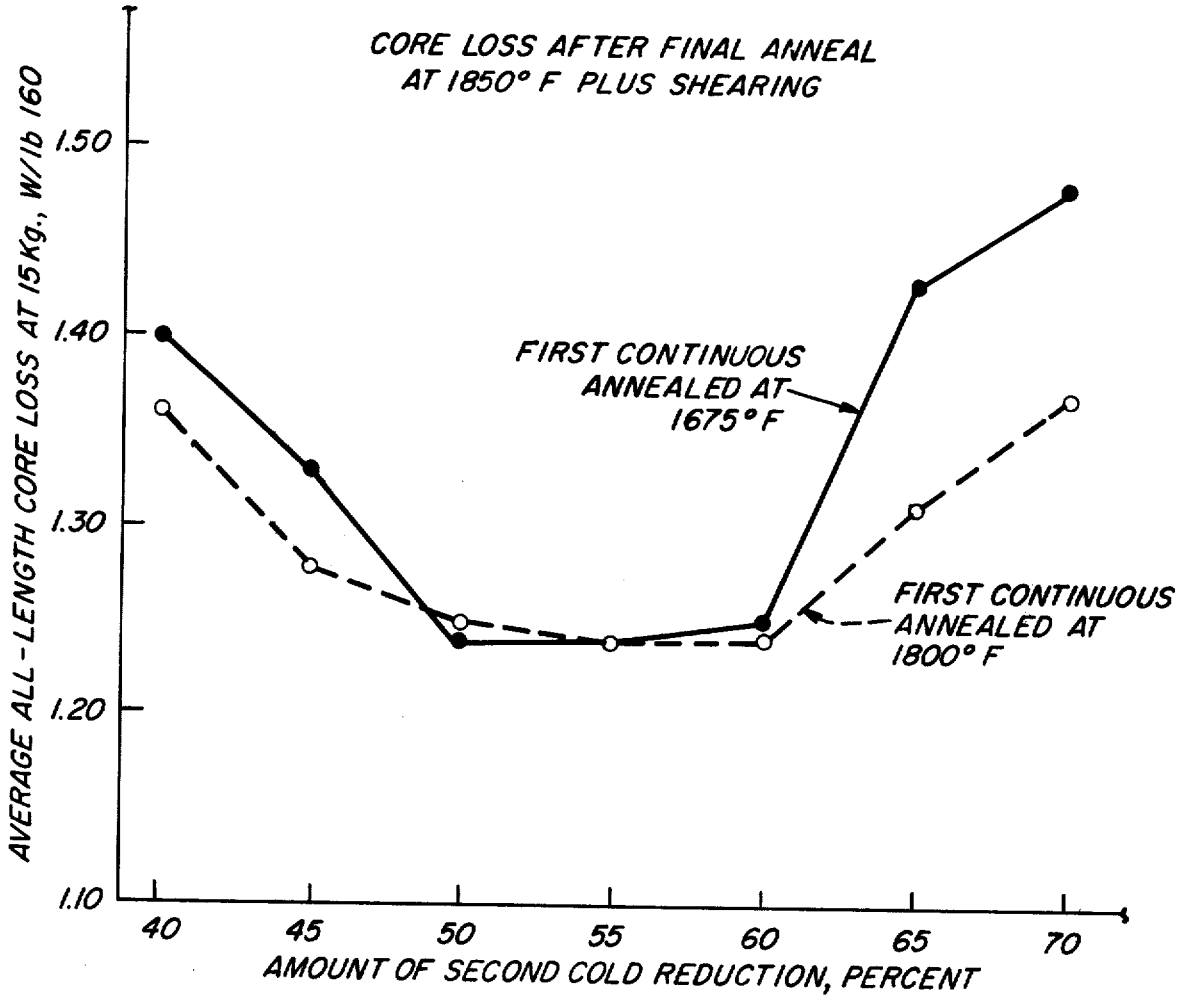
FIG. 1 is a graph showing the average all-length core loss at 15 kilogausses (15KG) of steels produced according to this process as a function of the amount of the second cold reduction.

Currently, commercial fully processed nonoriented silicon sheet steels are produced by one of three processes. Perhaps the most common process involves hot rolling a steel slab containing about 3% silicon to hot band gage, pickling the hot rolled steel, cold rolling to final gage, annealing to decarburize and recrystallize and finally providing a high temperature anneal to develop the magnetic properties. The other two commercial practices are substantially the same except that in one, the cold rolled steel is given a modest temper rolling of 2 to 5% between the two final anneals, and in the other, the hot rolled steel is normalized and pickled prior to cold rolling to final gage by a single cold-reduction processing sequence.

In the preferred practice of this inventive process, it is first essential to form a steel slab containing 2.0 to 3.5% silicon, 0.30 to 0.45% aluminum and not more than 0.007% sulfur. The aluminum content is considerably higher and the sulfur is considerably lower than the amounts generally required to develop a high degree of orientation and good magnetic properties in grain-oriented silicon steels. The balance, of course, must be iron and the usual impurities, i.e.

| | |
|---|---|
| copper | 0.20% maximum; |
| nickel | 0.10% maximum; |
| chromium | 0.10% maximum; |
| molybdenum | 0.030% maximum; |
| tin | 0.025% maximum; and |
| nitrogen | usually 0.004 to 0.008%. |

In the practice of this inventive process, a slab, having the above composition is reheated to a temperature within the range 2150° to 2250° F and hot rolled in accordance with conventional processes to hot band gage, i.e. to about 0.070 to 0.090-inch. Typically, the finishing temperature is about 1600° F or within the range 1490° to 1730° F, and the coiling temperature about 1125° F or within the range 950° to 1235° F. As is conventional prior art practice, the hot rolled steel must be pickled prior to cold rolling to remove mill scale from the surface.

Following hot rolling and pickling, the hot rolled steel can be cold rolled without the need of a normalizing treatment. However, instead of cold rolling the steel to final gage in one rolling as in conventional prior art practice, the process of this invention requires a double cold reduction with an intermediate anneal, or intermediate normalizing treatment. The double cold reduction should be such that the second cold reduction, after the intermediate anneal, effect a critical thickness reduction of from 50 to 60% to final gage. Accordingly, the extent of the first cold reduction will vary depending upon the thickness of the hot band and the final gage required, and should be such as will permit the 50 to 60% reduction in the second cold roll. The intermediate anneal between cold rolling steps, is preferably a continuous anneal in a protective atmosphere. However, an intermediate normalizing treatment may be used. Since normalizing involves air cooling, it will of course be necessary to pickle the steel following a normalizing treatment. In either event, the intermediate treatment, either annealing or normalizing must be effected at temperatures within the range 1625° to 1800° F.

After cold rolling to final gage, as described above, the cold rolled steel is given a decarburizing anneal and then a final high temperature anneal as in conventional prior art practices. Typically, the decarburizing anneal is effected at temperatures within the range 1450° to 1500° F in a wet atmosphere, i.e. +70° F dew point or higher and in a nitrogen-hydrogen gas atmosphere containing up to about 60% hydrogen. The final anneal is effected at temperatures as high as attainable, typically 1750° to 1900° F in a protective atmosphere. The final anneal is also preferably a continuous anneal in a protective atmosphere consisting of nitrogen and hydrogen but with dew points generally less than +20° F.

Silicon sheet steels produced in accordance with the above process, particularly the thinner gage sheets, such as 29-gage, will have substantially better magnetic properties in the rolling direction than the prior art nonoriented silicon sheet steels. For example, prior art 29-gage M-19 grade silicon sheet steels typically have fully processed all-length 15KG core loss (i.e. in the rolling direction) on the order of about 1.35 to 1.45 w/lb/60, and all-length 15KG permeabilities of about 2,000 or less. The silicon sheet steels produced by this inventive process to 29-gage are characterized by 15KG core losses of about 1.20 to 1.30 w/lb/60 and 15 KG permeabilities of about 2,200 to 3,500 in the rolling direction. Accordingly, because of these superior all-length magnetic properties, the silicon sheet steels produced by the above process are ideally suited for use in transformers utilizing the best magnetic properties of the sheet in high flux directions.

To exemplify the critical features of this invention, a number of tests were conducted to establish the critical nature of the second cold rolling step and temperature of first continuous anneal. Specimens were laboratory processed starting with 0.086-inch thick band-gage samples taken from a commercial hot-rolled and pickled coil of Grade 775 steel. The ladle composition of the steel, in weight percent was 0.039% C, 0.29% Mn, 0.013% P, 0.006% S, 3.08% Si, 0.38% Al, 0.02% Cu, 0.02% Ni, 0.02% Cr, 0.010% Mo, 0.007% N. The samples were processed into 29-gage specimens using the double cold reduction treatment of this invention. The hot-rolled samples were pickled to remove the surface oxide and were then cold reduced to various intermediate thicknesses as shown in Table I with amounts of cold reduction ranging from 73.8 to 44.7%. The cold reduced steel was then continuous annealed at either 1675° F or 1800° F for a total heating time of 3 minutes. The annealing was conducted in a dry HNX atmosphere containing about 15% hydrogen. All samples were then cold reduced to a final thickness of 0.0135 inch. The amounts of second cold reduction ranged from 40 to 70% as shown in Table I. The steels were subsequently decarburized to about 0.004% maximum carbon content during a continuous anneal for 5 minutes at 1475° F in a moist, +70° F dew point, HNX atmosphere containing 15% hydrogen. After this anneal the samples received a final high-temperature continuous anneal for 4 minutes at 1850° F in a dry HNX atmosphere containing 15% hydrogen. The samples were sheared into 3 by 28 cm Epstein strips and tested for core loss and permeability at 15 kilogausses (15KG). The results are listed in Table I. For control purposes additional samples were processed by the usual practices for M-19 grade; that is, the samples were normalized at 1675° F, pickled, cold reduced from band gauge to a final gage of 0.0135 inch, and then decarburized and high-temperature continuous annealed in the same manner as the double cold reduced steel specimens.

TABLE I

ALL-LENGTH FULLY PROCESSED MAGNETIC PROPERTIES* (AS-SHEARED TESTS)

| Thickness After First Cold Reduction, inch | % Cold Reduction | | First CA Temp., 1675° F 15-KG | | First CA Temp., 1800° F 15-KG | |
|---|---|---|---|---|---|---|
| | First | Second | Core Loss, w/lb/60 | Perm. | Core Loss, w/lb/60 | Perm. |
| Double Cold Reduction Treatment | | | | | | |
| 0.0225 | 73.8 | 40 | 1.40 | 1777 | 1.36 | 1949 |
| 0.0245 | 71.5 | 45 | 1.33 | 2099 | 1.28 | 2500 |
| 0.0270 | 68.6 | 50 | 1.24 | 2687 | 1.25 | 2425 |
| 0.0300 | 65.1 | 55 | 1.24 | 2668 | 1.24 | 2572 |
| 0.0338 | 60.7 | 60 | 1.25 | 2692 | 1.24 | 2652 |
| 0.0368 | 55.1 | 65 | 1.41 | 1767 | 1.31 | 2257 |
| 0.0450 | 47.7 | 70 | 1.48 | 1531 | 1.37 | 1988 |
| Single Cold Reduction Treatment (Control)** | | | | | | |
| 0.0135 | 84.3 | — | 1.57 | 1295 | — | — |

Figure 2:
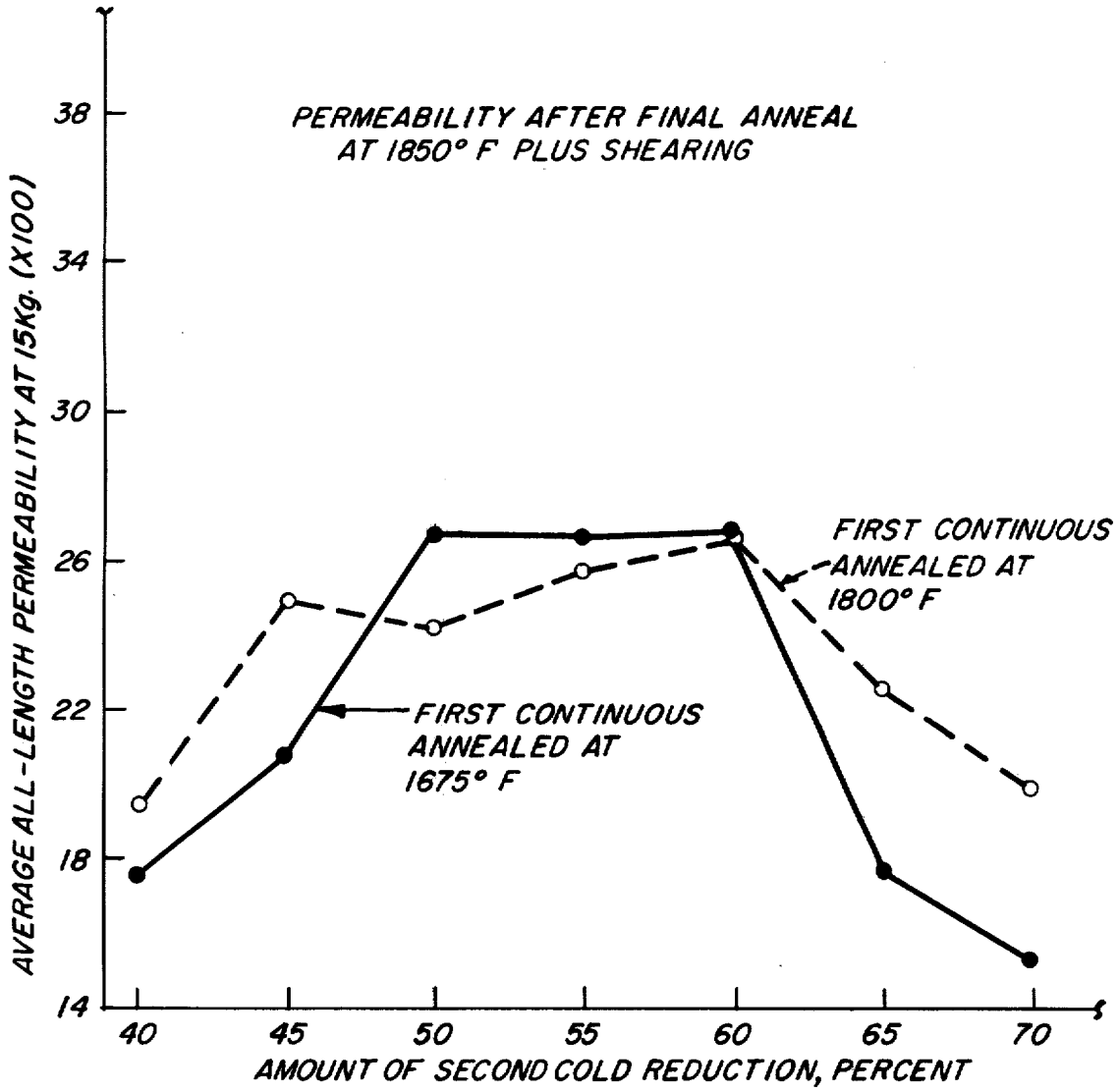
FIG. 2 is a graph showing the average all-length *a–c* permeability at 15KG of steels produced according to this process as a function of the amount of the second cold reduction.

*Each value is average of 2 tests except results for 50, 55 and 60% cold reduced steels and the control steel are averages of 4 tests.
**These specimens were normalized at 1675° F prior to cold reduction.
CA = continuous anneal
Perm. = a-c permeability To graphically illustrate the critical nature of the second cold roll, the above data has been plotted to show the all-length core losses and permeabilities at 15KG as a function of the second cold reduction, see FIGS. 1 and 2. Plots are shown for both intermediate annealing at 1675° and 1800° F. The points in the graph represent the average of two tests, except for 50, 55 and 60% cold reductions which are the average of four tests. From the two figures it can readily be seen that the 50 to 60% cold reduction in the second cold roll is critical in achieving optimum magnetic properties.

Figure 3:
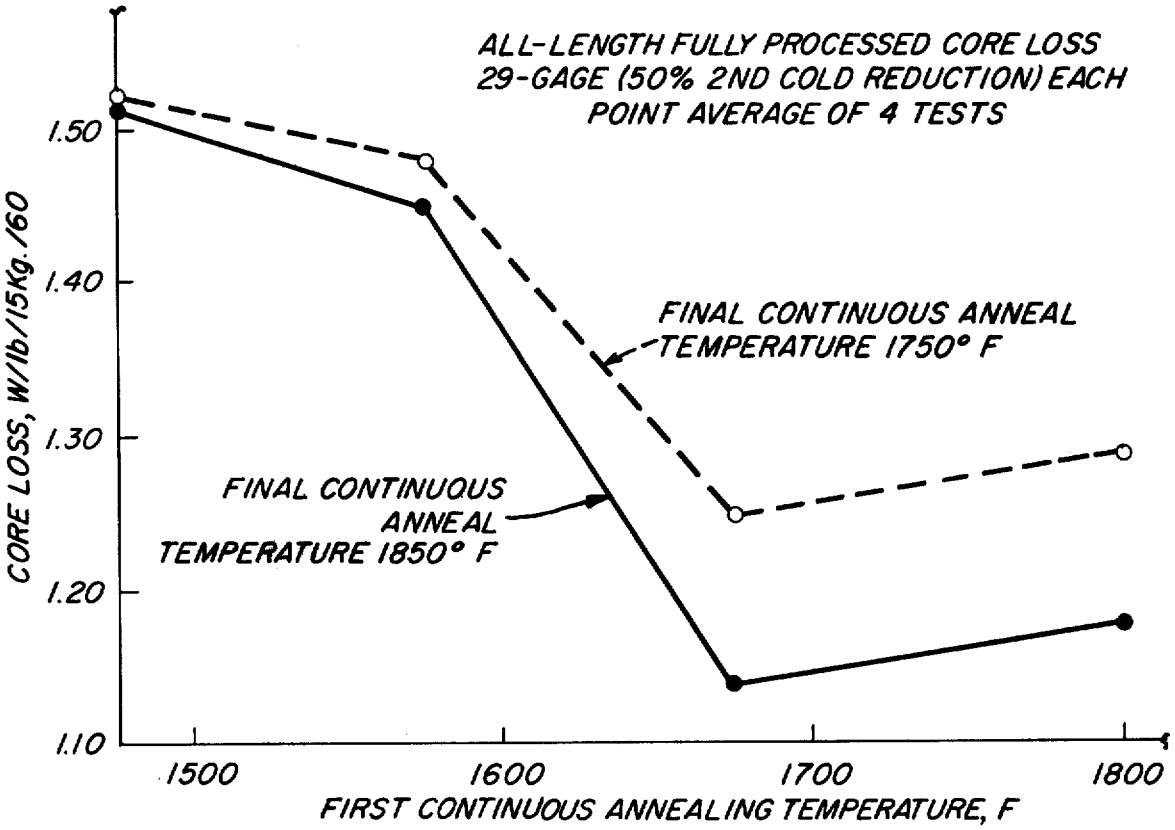
FIG. 3 is a graph showing the effect of the temperature of the first heat treatment after cold reduction to an intermediate sheet thickness and of the temperature of the final heat treatment on the all-length core loss at 15KG of the fully processed steel.
Figure 4:
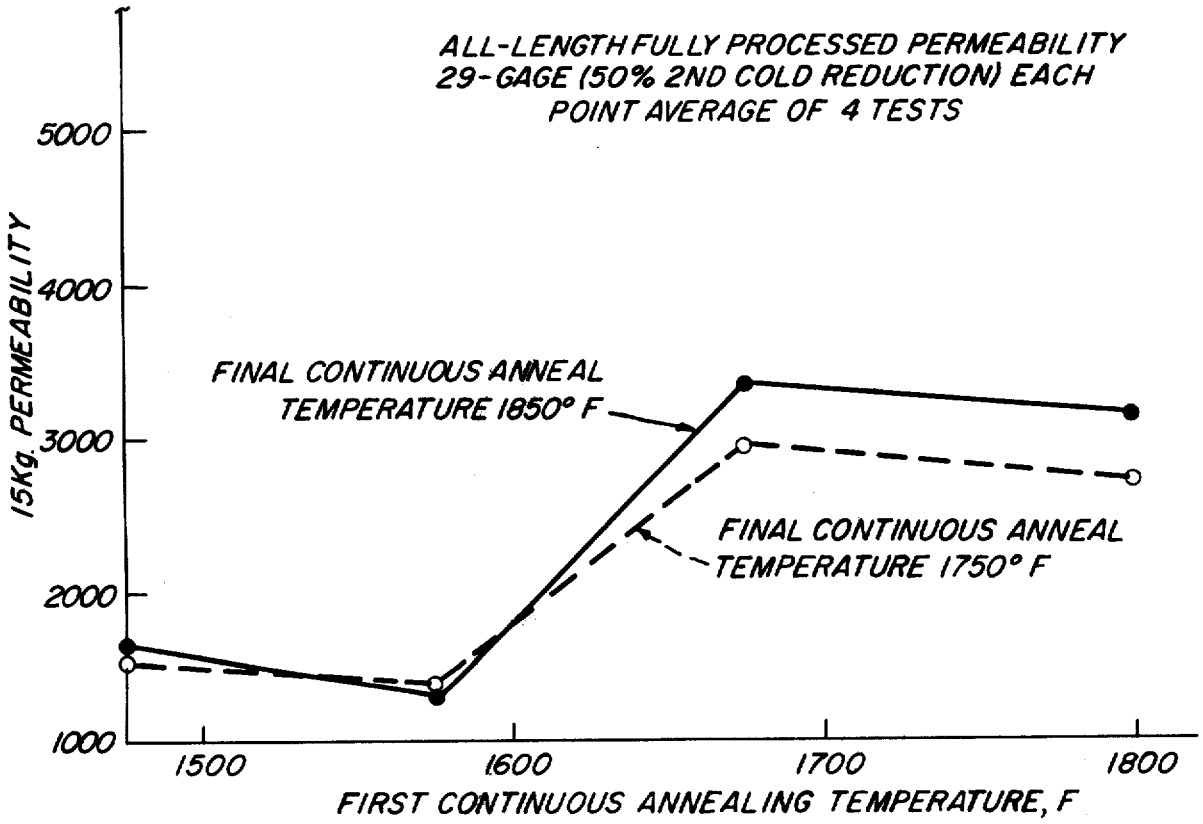
FIG. 4 is a graph showing the effect of the temperature of the first heat treatment after cold reduction to an intermediate sheet thickness on the final all-length permeability at 15KG.

As a further illustration of the critical parts of the process, data are shown in Table II and FIGS. 3 and 4 which illustrate the effect of the temperature of the first continuous anneal on the final magnetic properties of double cold reduced steel. The steel was the same as that used for the previous example. The samples were heated for a total of 3 minutes at each of the indicated temperatures. After the final cold reduction and decarburizing anneal the samples were continuous annealed for 4 minutes at either 1750° or 1850° F in dry HNX atmosphere to develop the final magnetic properties. As shown in FIGS. 3 and 4 the best magnetic properties are obtained when the first annealing temperature approaches 1700° F although good all-length 15KG core loss and permeability are developed in the range about 1625° to 1800° F. The plots also show that the properties are further improved as the final annealing temperature was increased from 1750° to 1850° F.

TABLE II

ALL-LENGTH FULLY PROCESSED MAGNETIC PROPERTIES (AS-SHEARED TEST)*

| First Continuous Anneal | | 10KG | | 15KG | |
|---|---|---|---|---|---|
| Temp., F | Time. mins. | CL | Perm. | CL | Perm. |
| FINAL CA AT 1850° F | | | | | |
| 1475 | 3 | 0.608 | 8339 | 1.51 | 1673 |
| 1575 | 3 | 0.591 | 8272 | 1.41 | 1346 |
| 1675 | 3 | 0.511 | 11917 | 1.14 | 3384 |
| 1800 | 3 | 0.520 | 11684 | 1.18 | 3187 |
| FINAL CA AT 1750° F | | | | | |
| 1475 | 3 | 0.635 | 9185 | 1.52 | 1576 |
| 1575 | 3 | 0.626 | 8506 | 1.48 | 1360 |
| 1675 | 3 | 0.565 | 10824 | 1.25 | 2975 |
| 1800 | 3 | 0.581 | 9887 | 1.29 | 2785 |

*Each value is average of 4 tests
CL = core loss, w/lb/60
Perm. = a-c permeability
CA = continuous anneal To exemplify the results achieved on production facilities, Table III below shows the results achieved in a mill trial of Grade 775 steel produced according to the above described process, to 29-gage AISI M-19 grade sheet.

TABLE III

EPSTEIN MAGNETIC PROPERTIES OF 29-GAGE MILL-PROCESSED M-19 GRADE COILS

| Coil No. | 15-KG Core Loss L | T | 1/2L and 1/2T | 15-KG Permeability L | T | 1/2L and 1.2T |
|---|---|---|---|---|---|---|
| Double Cold Reduced Coils* | | | | | | |
| 126021 | 1.26 | 1.89 | 1.51 | 2220 | 628 | 1152 |
| 126022 | 1.29 | 1.86 | 1.52 | 2170 | 630 | 1161 |
| 288709 | 1.18 | 1.88 | 1.49 | 2700 | 548 | 1149 |
| Single Cold Reduced Control Coils | | | | | | |
| 126023 | 1.40 | 1.78 | 1.58 | 1372 | 707 | 998 |
| 126024 | 1.40 | 1.77 | 1.57 | 1524 | 739 | 1068 |
| 126025 | 1.38 | 1.76 | 1.57 | 1435 | 732 | 998 |
| 126026 | 1.38 | 1.77 | 1.56 | 1681 | 761 | 1119 |
| 126027 | 1.37 | 1.73 | 1.54 | 1490 | 715 | 1006 |

*Intermediate thickness - 0.030 inch
L = Longitudinal
T = Transverse
core loss, w/lb/60

Two of the coils (Coil No. 126021 and 126022) in Table III were from a commercial heat having 0.03% C, 0.28% Mn, 0.010% P, 0.003% S, 2.99% Si, 0.36% Al and 0.005% N. The hot rolled and pickled coils were cold reduced to an intermediate thickness of about 0.030 inch and were then continuous annealed at 1800° F in a roller-hearth line at a line speed of 200 fpm. An atmosphere of nitrogen and 41 to 47% hydrogen with a dew point of +30° to +50° F was used. The coils were then cold reduced to 0.014 inch in 3 passes on a 54-inch reversing mill. Following the second cold reduction the coils were continuous annealed at 1475° to 1500° F at a line speed of 150 fpm and in a 50% nitrogen-hydrogen atmosphere with a dew point of +104° F to +116° F. The final anneal was conducted at 1900° to 1930° F at a line speed of 260 fpm and in a nitrogen-hydrogen atmosphere containing 48 to 53% hydrogen and a dew point of 20° to 40° F. The last two anneals were also conducted in a roller-hearth line. Coil No. 288709 was selected from another commercial heat. The ladle composition of this coil was 0.032% C, 0.29% Mn, 0.007% P, 0.004% S, 2.93% Si, 0.42% Al and 0.007% N. This coil was processed in the same manner as the previous coils except that the temperature of the first continuous anneal was 1750° to 1800° F. Five additional coils from the same heat as the first two coils were processed to 29-gage M-19 product by the conventional single cold roll practice as used in commercial production.

From the above table it can be seen that the process of this invention will yield 29-gage sheet having all-length 15KG core loss values below 1.30 w/lb/60 and all-length permeabilities well in excess of 2000.

The improvement in magnetic properties of the double cold reduced steel as compared with the single cold reduced steel is believed to be attributable to a more favorable crystallographic texture in the former steel as evidenced by differences in the relative X-ray intensities diffracted from crystallographic planes in the rolling plane. Although the orientations of the steels were found to be generally weak, one major difference between the double cold reduced and the single cold reduced steels was in the large intensity or volume fraction of (222) grains lying parallel to the plane of the sheet in the single cold reduced sheet. Whereas the relative intensity of (222) planes was 1.1 to 1.5 times random for the double cold reduced steel, it was 5 times random for the single cold reduced steel. Generally, the (222) or (111) orientation is not a favorable orientation for electrical sheets. There were also small but significant differences in intensities of (110) and (200) reflection between the sheets processed by these treatments.

I claim:

1. A process for producing thin-gage substantially non-oriented silicon sheet steel but nevertheless having a slight degree of orientation to provide superior magnetic properties in the rolling direction the steps comprising:

a. forming a steel slab consisting of 2.0 to 3.5% silicon, 0.30 to 0.45% aluminum, not more than 0.007% sulfur with the balance iron and usual impurities;

b. heating said slab to a temperature within the range 2150° to 2250° F;

c. hot rolling said slab to hot band gage;

d. pickling the hot rolled steel;

e. cold rolling said steel with a two step cold reduction wherein the second cold roll effects a thickness reduction of from 50 to 60% and the steel is given an intermediate anneal between the two cold rolls at a temperature of from 1625° to 1800° F;

f. annealing the cold rolled steel at a temperature of 1450° to 1500° F in a wet atmosphere sufficient to decarburize said steel; and g. finally annealing the decarburized steel at a temperature of from 1700° to 1900° F in a nonoxidizing atmosphere to develop superior magnetic properties in the rolling direction; said final annealed steel, when rolled to 29-gage, characterized by an all length 15KG core loss of less than 1.50 w/lb/60 and permeability of more than 2200.

* * * * *